US007760151B2

(12) United States Patent
Poilasne et al.

(10) Patent No.: US 7,760,151 B2
(45) **Date of Patent: *Jul. 20, 2010**

(54) SYSTEMS AND METHODS FOR A CAPACITIVELY-LOADED LOOP ANTENNA

(75) Inventors: Gregory Poilasne, San Diego, CA (US); Jorge Fabrega-Sanchez, San Diego, CA (US); Mete Ozkar, San Diego, CA (US); Vaneet Pathak, San Diego, CA (US)

(73) Assignee: Kyocera Corporation, Kyoto (JP)

( * ) Notice: Subject to any disclaimer, the term of this patent is extended or adjusted under 35 U.S.C. 154(b) by 223 days.

This patent is subject to a terminal disclaimer.

(21) Appl. No.: 11/754,042

(22) Filed: May 25, 2007

(65) Prior Publication Data

US 2007/0222698 A1 Sep. 27, 2007

Related U.S. Application Data

(62) Division of application No. 10/940,935, filed on Sep. 14, 2004, now Pat. No. 7,239,290.

(51) Int. Cl.
*H01Q 11/12* (2006.01)

(52) U.S. Cl. ..... 343/742; 343/743

(58) Field of Classification Search ..... 343/702, 343/742, 741, 743, 749, 866, 867
See application file for complete search history.

(56) References Cited

U.S. PATENT DOCUMENTS

| | | | | |
|---|---|---|---|---|
| 3,882,506 | A | 5/1975 | Mori et al. | |
| 5,442,369 | A * | 8/1995 | Van Voorhies et al. | 343/742 |
| H1571 | H | 8/1996 | Hansen et al. | |
| 6,020,857 | A | 2/2000 | Podger | |
| 6,144,346 | A | 11/2000 | Boy | |
| 6,204,817 | B1 | 3/2001 | Edvardsson | |
| 6,239,755 | B1 | 5/2001 | Klemens et al. | |
| 6,329,955 | B1 | 12/2001 | McLean et al. | |
| 6,456,243 | B1 | 9/2002 | Poilasne et al. | |
| 6,486,848 | B1 | 11/2002 | Poilasne et al. | |
| 6,515,632 | B1 | 2/2003 | McLean | |
| 6,573,867 | B1 | 6/2003 | Desclos et al. | |

(Continued)

FOREIGN PATENT DOCUMENTS

| | | |
|---|---|---|
| DE | 8814993 | 3/1989 |

(Continued)

*Primary Examiner*—Douglas W Owens
*Assistant Examiner*—Minh D A

(57) ABSTRACT

A capacitively-loaded loop antenna and corresponding radiation method have been provided. The antenna comprises a transformer loop having a balanced feed interface and a capacitively-loaded loop radiator. In one aspect, the capacitively-loaded loop radiator is a balanced radiator. In another, the transformed loop and capacitively-loaded loop radiator are physically connected. That is, the transformer loop and the capacitively-loaded loop radiator have a portion shared by both of the loop perimeters. Alternately, the loops are physically independent of each other. In one aspect, the perimeters have a rectangular shape. Other shapes such as round or oval are also possible. In another aspect, the planes formed by the transformer and capacitively-loaded loop radiator can be coplanar or non-planar, while both loops are orthogonal to a common magnetic near-field generated by the transformed loop. The radiator has a capacitively-loaded side, or capacitively loaded perimeter section, depending on the shape of the perimeter.

11 Claims, 9 Drawing Sheets

U.S. PATENT DOCUMENTS

| | | | | |
|---|---|---|---|---|
| 6,600,450 | B1 | 7/2003 | Efanov et al. | |
| 6,608,602 | B2 * | 8/2003 | Waltho et al. | 343/850 |
| 6,624,795 | B2 * | 9/2003 | Boyle | 343/895 |
| 6,675,461 | B1 | 1/2004 | Rowson et al. | |
| 6,693,599 | B1 | 2/2004 | Chia et al. | |
| 6,697,025 | B2 | 2/2004 | Koyanagi et al. | |
| 6,717,551 | B1 | 4/2004 | Desclos et al. | |
| 6,765,846 | B2 | 7/2004 | Saitou et al. | |
| 6,911,940 | B2 | 6/2005 | Poilasne et al. | |
| 6,958,735 | B2 * | 10/2005 | Handelsman | 343/742 |
| 7,187,332 | B2 * | 3/2007 | Kezys et al. | 343/702 |
| 7,274,338 | B2 * | 9/2007 | Ozkar et al. | 343/793 |
| 7,408,517 | B1 * | 8/2008 | Poilasne et al. | 343/742 |
| 7,427,965 | B2 * | 9/2008 | Fabrega-Sanchez et al. | 343/795 |
| 2004/0174316 | A1 * | 9/2004 | Keren | 343/867 |
| 2006/0038730 | A1 | 2/2006 | Parsche | |
| 2006/0055618 | A1 | 3/2006 | Poilasne et al. | |
| 2007/0152891 | A1 * | 7/2007 | Fabrega-Sanchez et al. | 343/702 |

FOREIGN PATENT DOCUMENTS

| | | |
|---|---|---|
| EP | 1134840 | 9/2001 |
| EP | 1217685 | 6/2002 |
| WO | WO 02/071536 | 9/2002 |

* cited by examiner

SYSTEMS AND METHODS FOR A CAPACITIVELY-LOADED LOOP ANTENNA

RELATED APPLICATIONS

This is a division of U.S. application Ser. No. 10/940,935, filed Sep. 14, 2004, now U.S. Pat. No. 7,239,290, which is hereby incorporated by reference.

BACKGROUND

1. Field of the Invention

This invention generally relates to wireless communication and, more particularly, to wireless communication antennas.

2. Description of the Related Art

The size of portable wireless communications devices, such as telephones, continues to shrink, even as more functionality is added. As a result, the designers must increase the performance of components or device subsystems and reduce their size, while packaging these components in inconvenient locations. One such critical component is the wireless communications antenna. This antenna may be connected to a telephone transceiver, for example, or a global positioning system (GPS) receiver.

State-of-the-art wireless telephones are expected to operate in a number of different communication bands. In the US, the cellular band (AMPS), at around 850 megahertz (MHz), and the PCS (Personal Communication System) band, at around 1900 MHz, are used. Other communication bands include the PCN (Personal Communication Network) and DCS at approximately 1800 MHz, the GSM system (Groupe Speciale Mobile) at approximately 900 MHz, and the JDC (Japanese Digital Cellular) at approximately 800 and 1500 MHz. Other bands of interest are GPS signals at approximately 1575

MHz, Bluetooth at approximately 2400 MHz, and wideband code division multiple access (WCDMA) at 1850 to 2200 MHz.

Wireless communications devices are known to use simple cylindrical coil or whip antennas as either the primary or secondary communication antennas. Inverted-F antennas are also popular. The resonance frequency of an antenna is responsive to its electrical length, which forms a portion of the operating frequency wavelength. The electrical length of a wireless device antenna is often at multiples of a quarter-wavelength, such as $5\lambda/4$, $3\lambda/4$, $\lambda/2$, or $\lambda/4$, where $\lambda$ is the wavelength of the operating frequency, and the effective wavelength is responsive to the physical length of the antenna radiator and the proximate dielectric constant.

Many of the above-mentioned conventional wireless telephones use a monopole or single-radiator design with an unbalanced signal feed. This type of design is dependent upon the wireless telephone printed circuit board groundplane and chassis to act as the counterpoise. A single-radiator design acts to reduce the overall form factor of the antenna. However, the counterpoise is susceptible to changes in the design and location of proximate circuitry, and interaction with proximate objects when in use, i.e., a nearby wall or the manner in which the telephone is held. As a result of the susceptibility of the counterpoise, the radiation patterns and communications efficiency can be detrimentally impacted.

A balanced antenna, when used in a balanced RF system, is less susceptible to RF noise. Both feeds are likely to pick up the same noise, and be cancelled. Further, the use of balanced circuitry reduces the amount of current circulating in the groundplane, minimizing receiver desensitivity issues.

It would be advantageous if wireless communication device radiation patterns were less susceptible to proximate objects.

It would be advantageous if a wireless communications device could be fabricated with a balanced antenna, having a form factor as small as an unbalanced antenna.

DETAILED DESCRIPTION

The present invention introduces a capacitively-loaded loop radiator antennas and methods. The antenna is balanced, to minimize susceptibility of the counterpoise to detuning effects that degrade the far-field electro-magnetic patterns. The balanced antenna also acts to reduce the amount of radiation-associated current in the groundplane, thus improving receiver sensitivity. The antenna loop is capacitively-loaded, to confine the electric field and so reduce the overall size (length) of the radiating elements.

Accordingly, a capacitively-loaded loop antenna is provided. The antenna comprises a transformer loop having a balanced feed interface and a capacitively-loaded loop radiator. In one aspect, the capacitively-loaded loop radiator is a balanced radiator. Alternately, the capacitively-loaded loop radiator can be considered to be a quasi-balanced radiator, as explained below, including a quasi loop and a bridge section. In one aspect, the transformed loop and quasi loop are physically connected. That is, the transformer loop has a perimeter and the quasi loop has a perimeter with at least a portion shared by the transformer loop perimeter. Alternately, the loops are physically independent of each other.

In another aspect, the perimeters have a rectangular shape. Other shapes such as round or oval are also possible. In another aspect, the planes formed by the transformer and quasi loop are coplanar. Alternately, the planes are non-planar, while both being orthogonal to a common magnetic near-field generated by the transformer loop. Thus, whether connected or not, the loops are coupled.

Typically, the quasi loop has a capacitively-loaded side, or capacitively-loaded perimeter section. The capacitively-loaded side includes the bridge section interposed between quasi loop end sections. The bridge section can be a dielectric gap or lumped element capacitor.

Figure 1A:
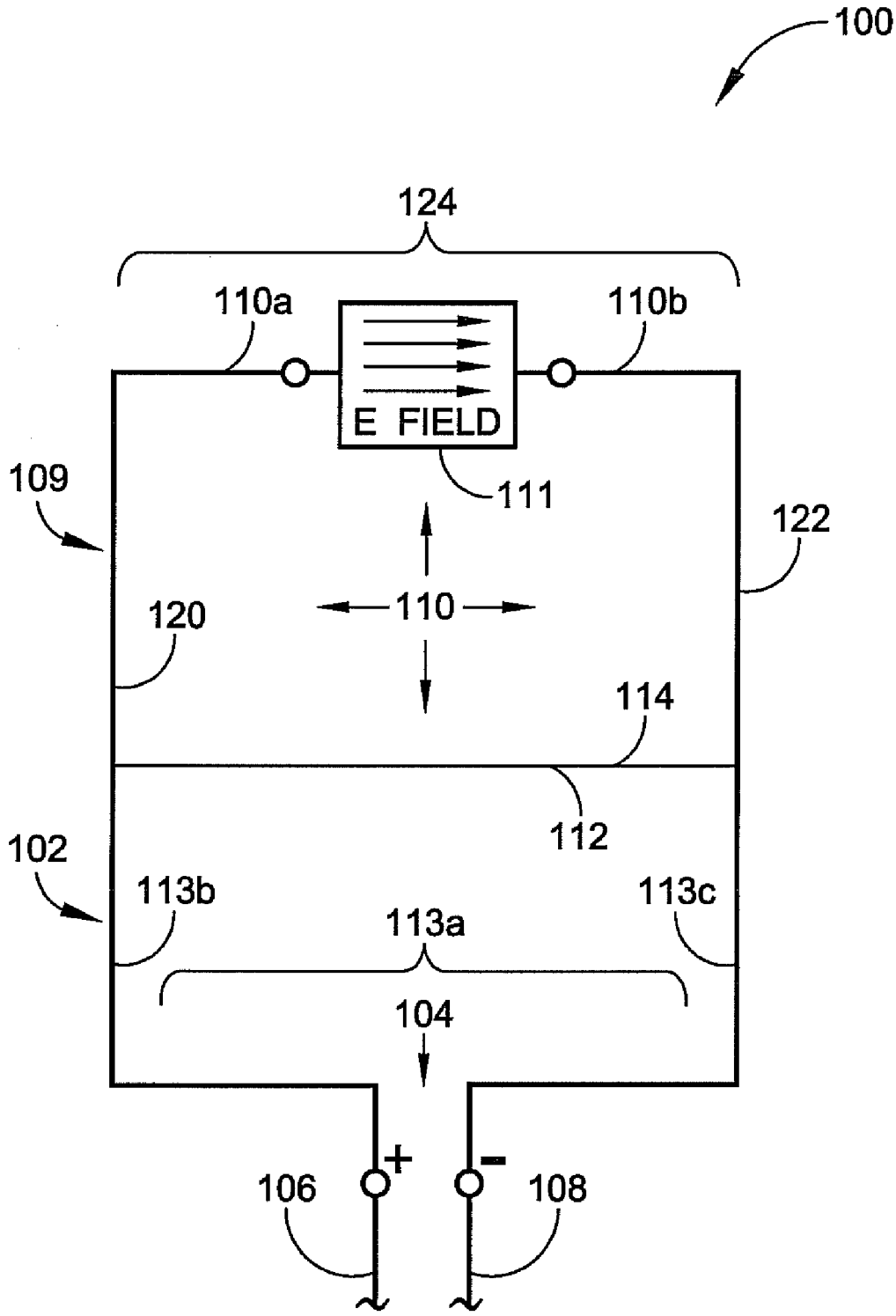
FIG. 1A is a plan view of the present invention capacitively-loaded loop antenna.

FIG. 1A is a plan view of the present invention capacitively-loaded loop antenna. The antenna 100 comprises a transformer loop 102 having a balanced feed interface 104. The balanced feed interface 104 accepts a positive signal on line 106 and a negative signal (considered with respect to the positive signal) on line 108. In some aspects, the signal on line 108 is 180 degrees out of phase of the signal on line 106. The antenna 100 also comprises a capacitively-loaded loop radiator (CLLR) 109.

Typically, the capacitively-loaded loop radiator 109 is a balanced radiator. A dipole antenna is one conventional example of a balanced radiator. The capacitive loading that advantageously affects to overall size of the CLLR 109, however, makes the antenna more susceptible to influences that unbalance the radiator. That is, the antenna is not always a perfectly balanced radiator, or is only perfectly balanced in a limited range of frequencies. For this reason, the CLLR 109 is sometimes described as a quasi-balanced radiator. The CLLR 109 includes a quasi loop 110 and a bridge section 111. As defined herein, a quasi loop 110 has loop end sections that are substantially, but not completely closed (in contact). The quasi loop 110 has a first end section 110*a* and second end section 110*b*. The bridge section 111 is interposed between the first end section 110*a* and the second end section 110*b*. The bridge section can be a dielectric gap capacitor (see FIG. 1B) or a lumped element capacitor (see FIG. 10). However, as explained below, the bridge section can be other elements that act to confine an electric field.

That is, the antenna 100 of FIG. 1A can be understood as a confined electric field magnetic dipole antenna. As above, the antenna comprises a transformer loop 102 having a balanced feed interface 104. In this aspect, however, the antenna further comprises a magnetic dipole 109 with an electric field confining section 111. That is, the antenna can be considered as comprising a quasi loop 110 acting as an inductive element, and a section 111 that confines an electric field between the quasi loop first and second end sections 110*a* and 110*b*. The magnetic dipole 109 can be a balanced radiator, or quasi-balanced. As above, the electric field confining section 111 can be a dielectric gap capacitor or a lumped element capacitor. The confined electric field section couples or conducts substantially all the electric field between first and second end sections 110*a*/110*b*. As used herein, "confining the electric field" means that the near-field radiated by the antenna is mostly magnetic. Thus, the magnetic field that is generated has less of an interaction with the surroundings or proximate objects. The reduced interaction can positively impact the overall antenna efficiency.

The transformer loop 102 has a radiator interface 112 and the quasi loop 110 has a transformer interface 114 coupled to the transformer loop radiator interface 112. As shown in FIG. 1A, the transformer loop 102 and quasi loop 110 are physically connected. That is, the transformer loop 102 has a first perimeter and the quasi loop 110 has a second perimeter with at least a portion of the second perimeter in common with the first perimeter. As shown, the loops 102 and 110 are approximately rectangular shaped. As such, the transformer loop 102 has a first side, which is the radiator interface 112. Likewise, the quasi loop 110 has a first side that is the transformer interface 114. Note that sides 112 and 114 are the same. The transformer loop 102 performs an impedance transformation function. That is, the transformer loop balanced feed interface 104 has a first impedance (conjugately matched to the balanced feed 106/108), and wherein the radiator interface 112 has a second impedance, different than the first impedance. Thus, the quasi loop transformer interface 114 has an impedance that conjugately matches the radiator interface second impedance. The perimeter of transformer loop is the sum of sides 112, 113*a*, 113*b*, and 113*c*. The perimeter of quasi loop 110 is the sum of sides 114, 120, 122, and 124.

For simplicity the invention will be described in the context of rectangular-shaped loops. However, the transformer loop 102 and quasi loop 110 are not limited to any particular shape. For example, in other variations not shown, the transformer loop and quasi loop 110 may be substantially circular, oval, shaped with multiple straight sections (i.e., a pentagon shape). Depending of the specific shape, it is not always accurate to refer to the radiator interface 112 and transformer interface 114 as "sides". Further, the transformer loop 102 and quasi loop 110 need not necessary be formed in the same shape. Even if the transformer loop 102 and the quasi loop 110 are formed in substantially the same shape, the perimeters or areas surrounded by the perimeters need not necessarily be the same. The word "substantially" is used above because the capacitively-loaded fourth side 124 (the first and second end sections 110*a*/110*b*) of the quasi loop 110 typically prevent the quasi loop from being formed in a geometrically perfect shape. For example, the quasi loop 110 of FIG. 1A is rectangular, but not a perfect rectangle.

Figure 2:
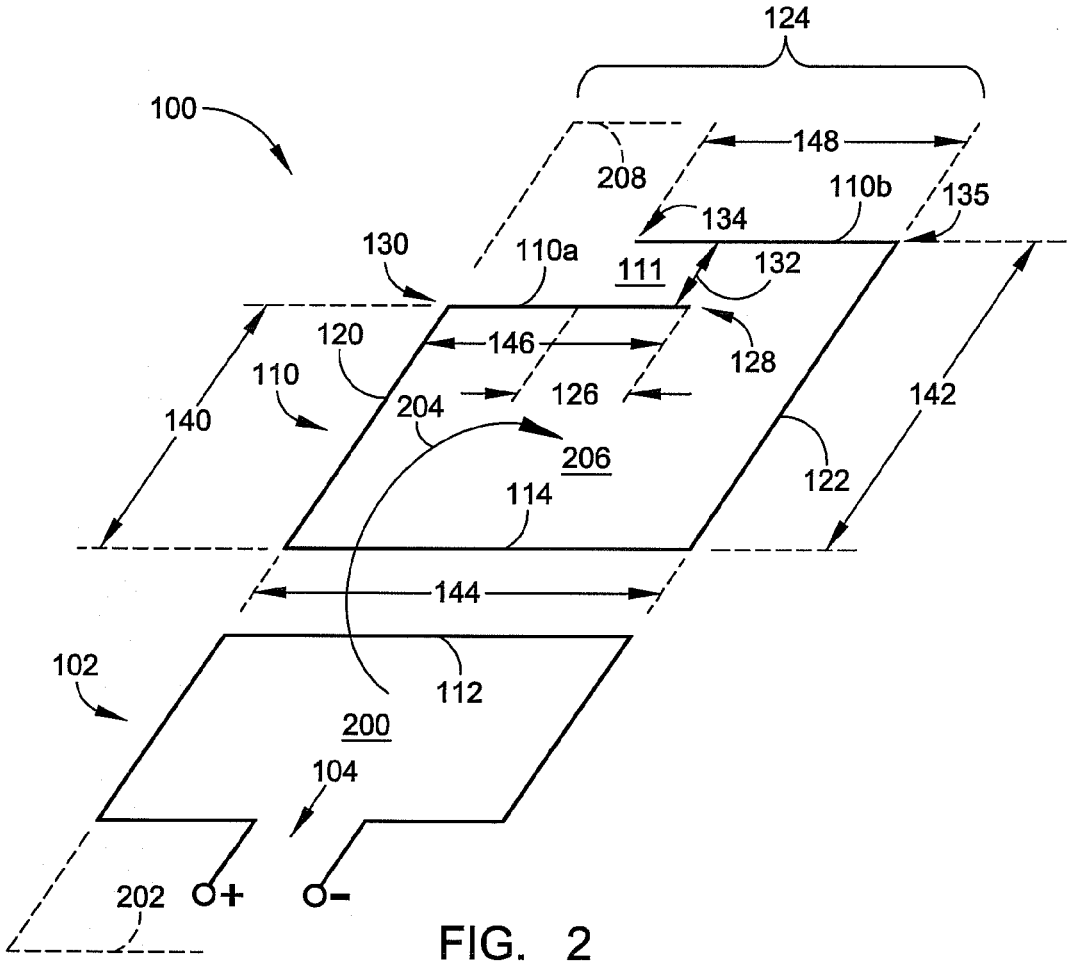
FIG. 2 is perspective view of a physically independent loop variation of the antenna of FIG. 1A.

FIG. 2 is perspective view of a physically independent loop variation of the antenna of FIG. 1A. In this variation, the transformer loop 102 and quasi loop 110 are not physically connected. Alternately stated, the transformer loop 102 and quasi loop 110 do not share any electrical current. Thus, the transformer loop 102 has a loop area 200 in a first plane 202 (shown in phantom) defined by a first perimeter, orthogonal to a first magnetic field (near-field) 204. The quasi loop 110 has a loop area 206 in a second plane 208 (in phantom), defined by a second perimeter, orthogonal to the first magnetic field 204. As shown, the transformer loop 102 first perimeter is physically independent of the quasi loop 110 second perimeter.

Referencing either FIG. 1A or FIG. 2, in one aspect of the antenna 100, the first plane 202 and the second plane 208 are coplanar (as shown).

Figure 3:
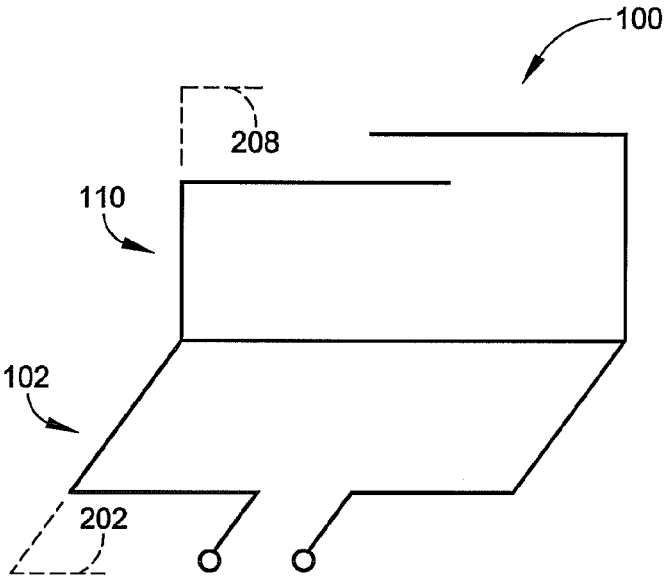
FIG. 3 is a perspective view showing a second variation of the antenna of FIG. 1A.

FIG. 3 is a perspective view showing a second variation of the antenna of FIG. 1A. In this variation, the transformer loop first plane 202 is non-coplanar with the second plane 208. Although the transformer loop 102 and quasi loop 110 are shown as physically connected, similar to the antenna in FIG. 1B, the first plane 202 and second plane 208 can also be non-coplanar in the physically independent loop version of the invention, similar to the antenna of FIG. 2.

Figure 1B:
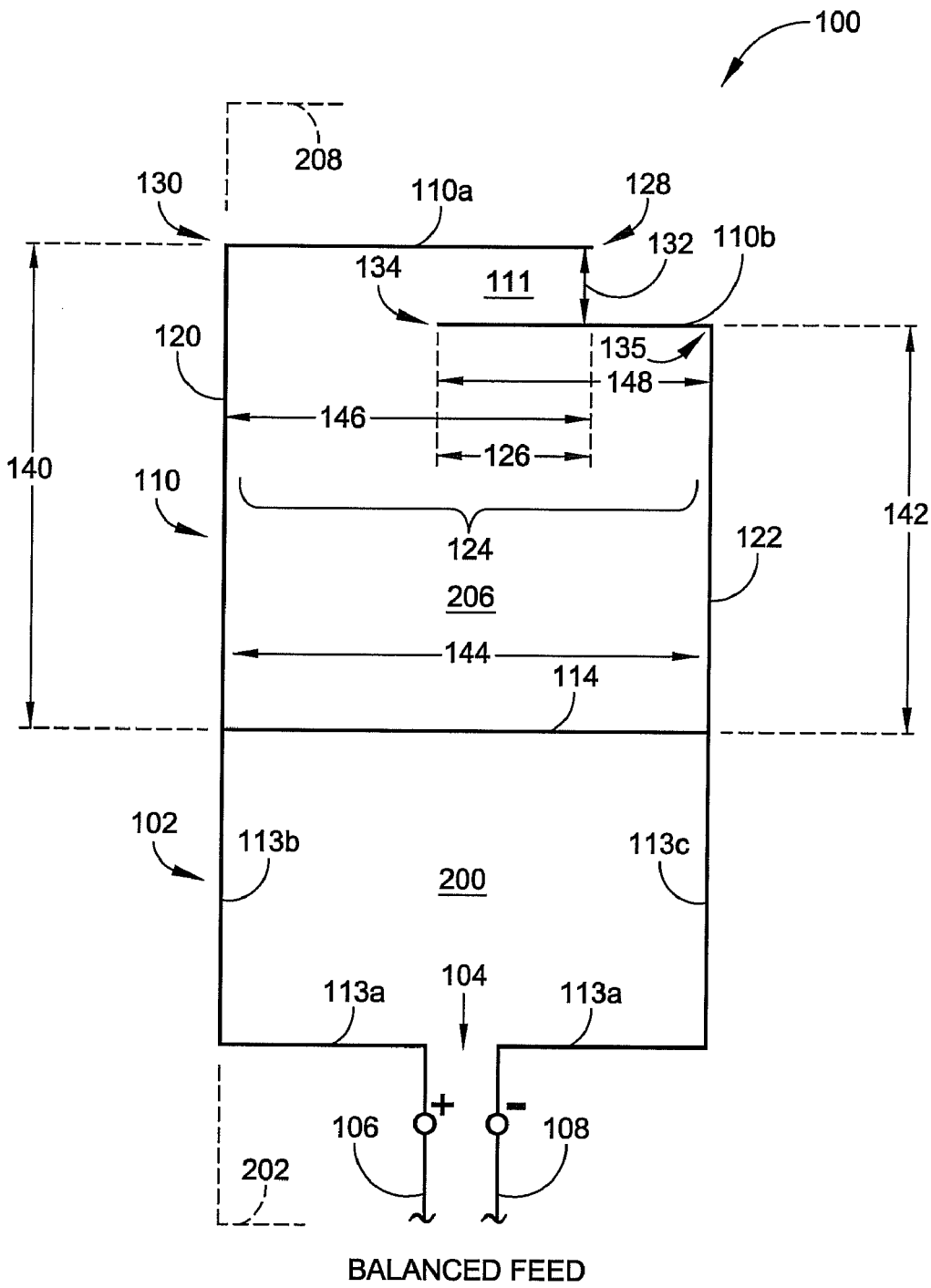
FIG. 1B is a plan view of a physically dependent loop variation of the antenna of FIG. 1A.

As shown, the first plane 202 and second plane 208 are non-coplanar (or coplanar, as in FIGS. 1B and 2), while being orthogonal to the near-field generated by the transformer loop 102. In FIGS. 1B, 2, and 3, the first and second planes 202/208 are shown as flat. In other aspects not shown, the planes may have surfaces that are curved or folded.

FIG. 1B is a plan view of a physically dependent loop variation of the antenna of FIG. 1A. The quasi loop first end section 110*a* includes a portion formed in parallel to a portion of the second end section 110*b*. Alternately stated, the first end section 110*a* and second end section 110*b* have portions that overlap, or portions that are both adjacent and parallel. Stated another way, the sum the first end section 110*a* and second end section 110*b* is greater than the fourth side 124, because of the parallel or overlapping portions. In this case, the bridge section 111 is a dielectric gap capacitor formed between the parallel portions of the first end section 110*a* and the second end section 110*b*.

Referencing either FIG. 1B or 2, the quasi loop 110 has second side 120 and a third side 122 orthogonal to the first side 114 and a capacitively-loaded fourth side 124 parallel to the first side 114. The capacitively-loaded fourth side 124 includes the first end section 110*a* with a distal end 128 connected to the second side 120, and a proximal end 130. The second end section 110*b* has a distal end 134 connected to the third side 122, and a proximal end 135. The bridge section (dielectric gap capacitor) 111 is formed between the first and second sections 110*a* and 110*b*, respectively. For example, the dielectric may be air. As noted above, the combination of the first side 114, second side 120, third side 122, and the capacitively-loaded side 124 define the quasi loop perimeter.

The second side 120 has a first length 140 and the third side 122 has second length 142, not equal to the first length 140. The first side 114 has a third length 144, the first end section 110*a* has a fourth length 146 and the second end section 110*b* has a fifth length 148. In this variation, the sum of the fourth length 146 and fifth length 148 is greater than the third length 144. In other rectangular shape variations, see FIGS. 5A and 5B, the second and third sides 120/122 are the same length, that is, the second and third sides 120/122 are the same length in a vertical plane, while the first and second end sections 110*a* and 110*b* are angled in a horizontal plane to avoid contact, forming a dielectric gap capacitor. An overlap, or parallel section 126 between the first end section 110*a* and the second and section 110*b* helps define the dielectric gap capacitance, as the capacitance is a function of a distance 132 between sections 110*a*/110*b* and the degree of overlap 126.

Figure 4A:
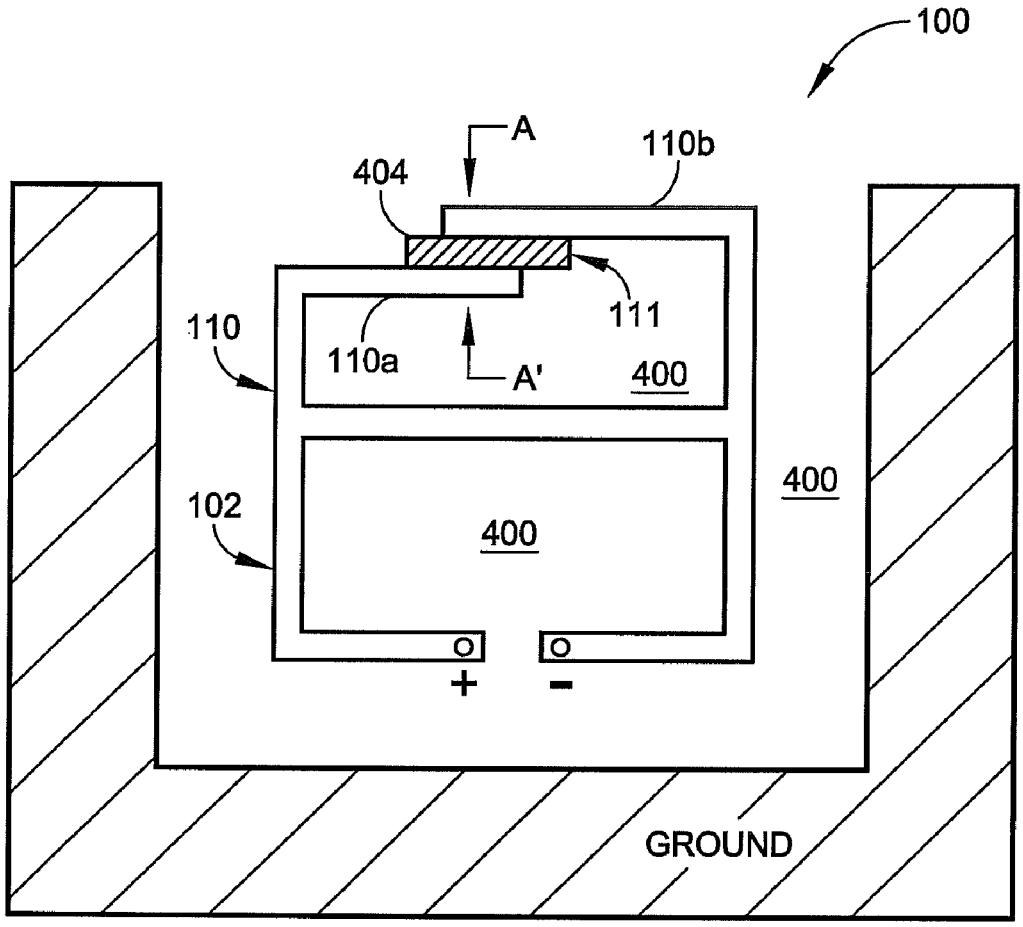
FIGS. 4A and 4B are plan and partial cross-sectional views, respectively, of a third variation of the antenna of FIG. 1A.
Figure 4B:
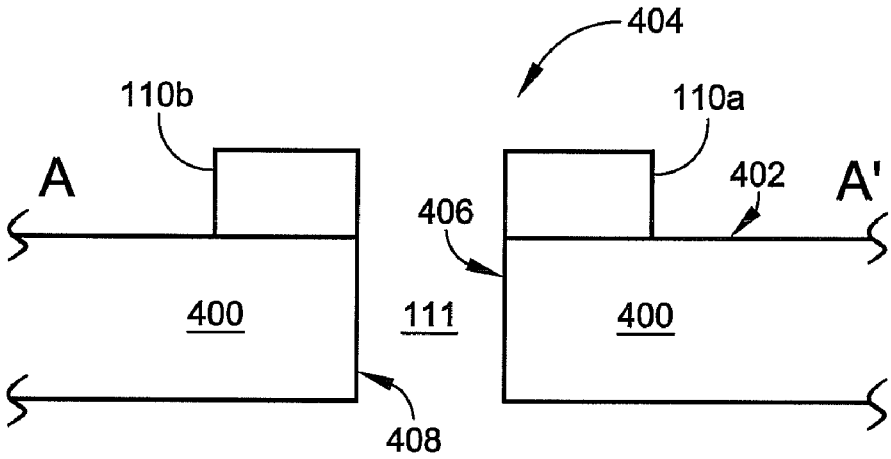

FIGS. 4A and 4B are plan and partial cross-sectional views, respectively, of a third variation of the antenna of FIG. 1A. Shown is a sheet of dielectric material 400 with a surface 402. For example, the dielectric sheet may be FR4 material, or a section of a PCB. The transformer loop 102 and quasi loop 110 are metal conductive traces formed overlying the sheet of dielectric material 400. For example, the traces can be ½ ounce copper. The dielectric material 400 includes a cavity 404. The cavity 404 is formed in the dielectric material surface 402 between a cavity first edge 406 and a cavity second edge 408. The quasi loop first end section 110*a* is aligned along the dielectric material cavity first edge 406, the second end section 110*b* is aligned along the cavity second edge 408. As shown, the bridge section 111 is an air gap capacitor formed in the cavity 404 between the cavity first and second edges 406/408. Alternately, the cavity 404 can be filled with a dielectric other than air.

Figure 5A:
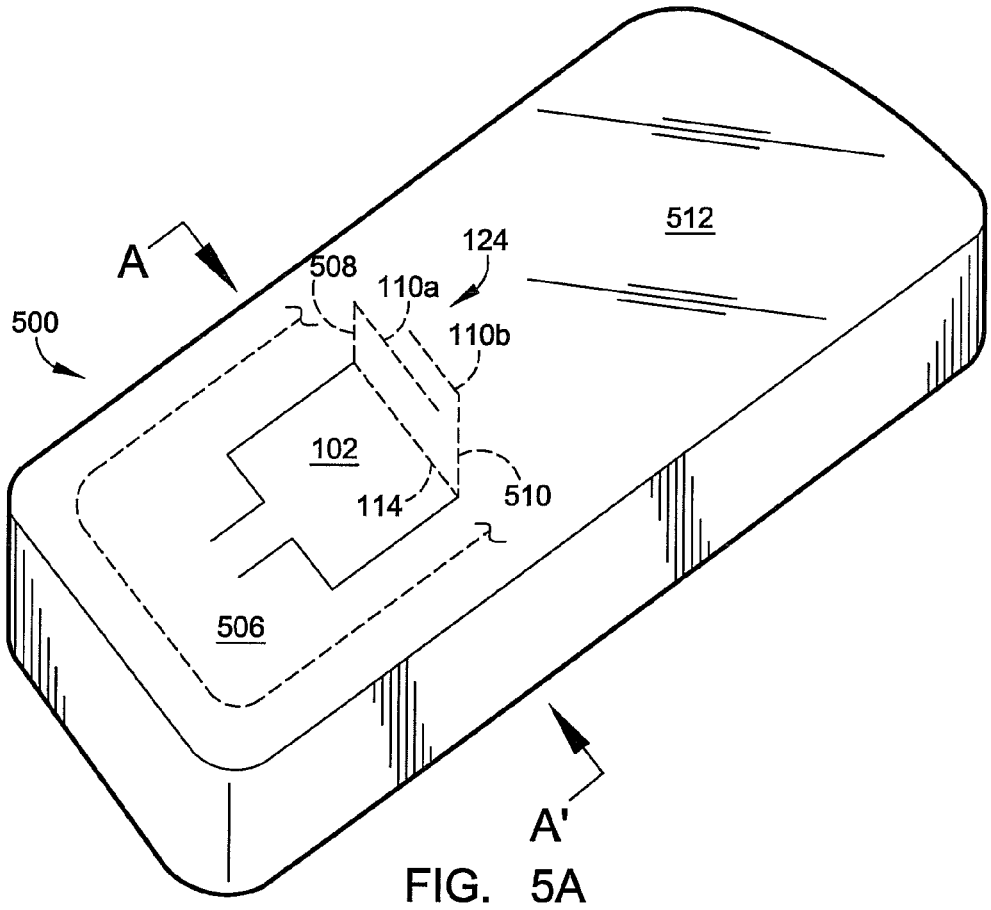
FIGS. 5A and 5B are plan and cross-sectional views, respectively, of a fourth variation of the antenna of FIG. 1A.
Figure 5B:
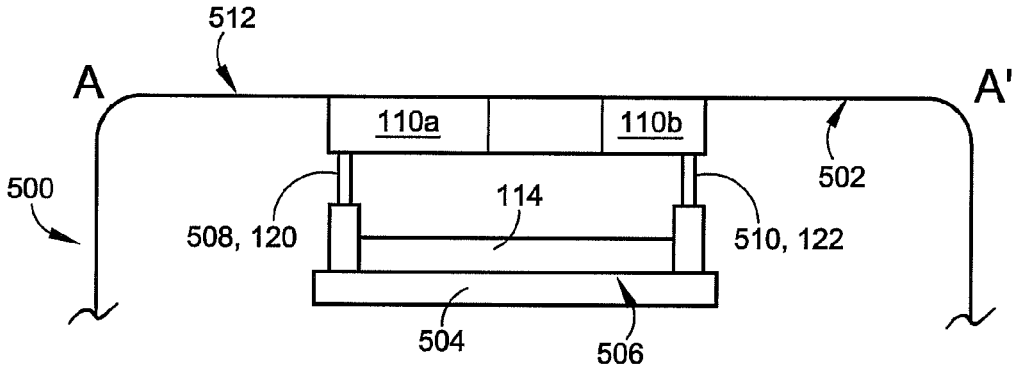

FIGS. 5A and 5B are plan and cross-sectional views, respectively, of a fourth variation of the antenna of FIG. 1A. Shown is a chassis 500 with a surface 502. In this example, the surface 502 is a chassis interior surface. A sheet of dielectric material 504 with a top surface 506, underlies the chassis surface 502. The transformer loop 102 and quasi loop first side 114 are metal conductive traces formed overlying the dielectric material top surface. Alternately but not shown, the traces can be internal to dielectric sheet 504, or on the opposite surface. The quasi loop fourth side 124, with sections 110*a* and 110*b*, is a metal conductive trace formed on the chassis surface 502. Alternately but not shown, the capacitively-loaded fourth side 124 is formed on a chassis outside surface, internal to the chassis, or at different levels in the chassis, i.e., on the inside and outside surfaces.

Pressure-induced electrical contact 508 forms the quasi loop second side 120 and pressure-induced electrical contact 510 forms the quasi loop third side 122, connecting the first side 114 to the fourth side 124. For example, the pressure-induced contacts 508/510 may be pogo pins or spring slips. As shown, the first end section 110*a* and second end section 110*b* are angled in the horizontal plane so that they do not touch, forming a dielectric gap capacitor. Alternately but not shown, the first end section 110*a* can be mounted to the chassis bottom surface 502 and the second end section 110*b* can be mounted to a chassis top surface 512. In this example not shown, the pressure-induced contact interfacing with the chassis top surface trace is longer than the contact interfacing with the chassis bottom surface trace, and sections 110*a*/110*b* do not need to be angled in the horizontal plane to avoid contact.

Figure 6:
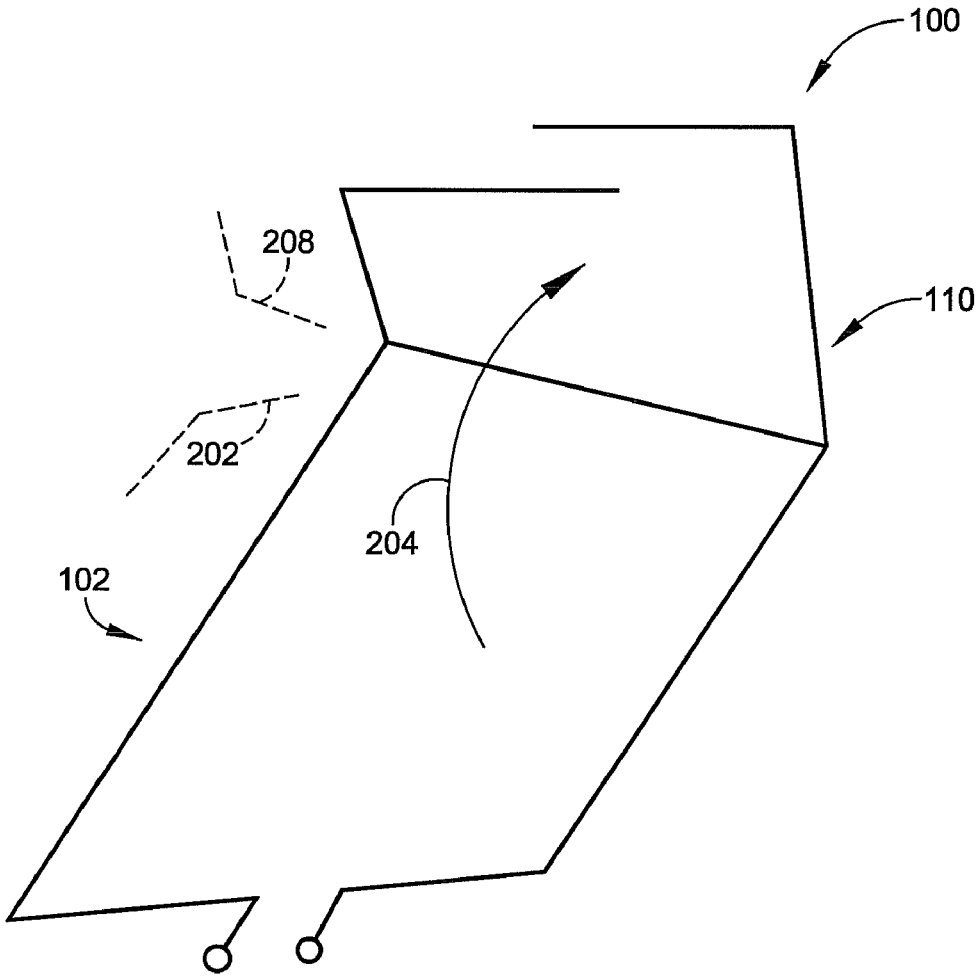
FIG. 6 is a depiction of a fifth variation of the antenna of FIG. 1A.

FIG. 6 is a depiction of a fifth variation of the antenna of FIG. 1A. In this variation, the quasi loop second plane 208 is not perfectly orthogonal to the magnetic near-field 204. Although not shown in this figure, this variation of the invention can be implemented in the physically independent loop antenna of FIG. 2.

Figure 10:
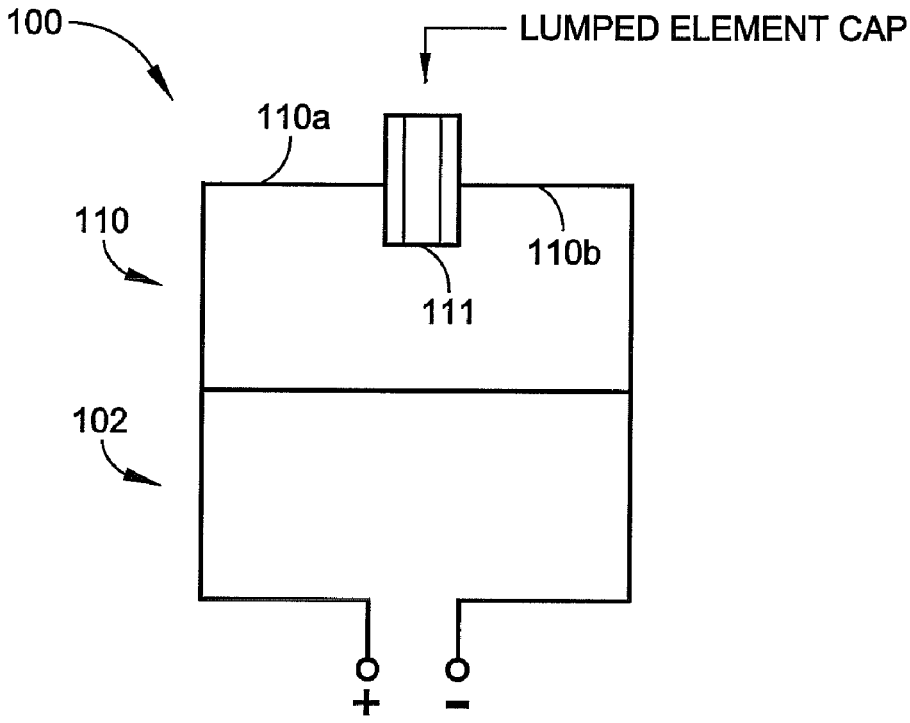
FIG. 10 is a depiction of a sixth variation of the antenna of FIG. 1A.

FIG. 10 is a depiction of a sixth variation of the antenna of FIG. 1A. As shown, the bridge section 111 is a lumped element capacitor.

Figure 11:
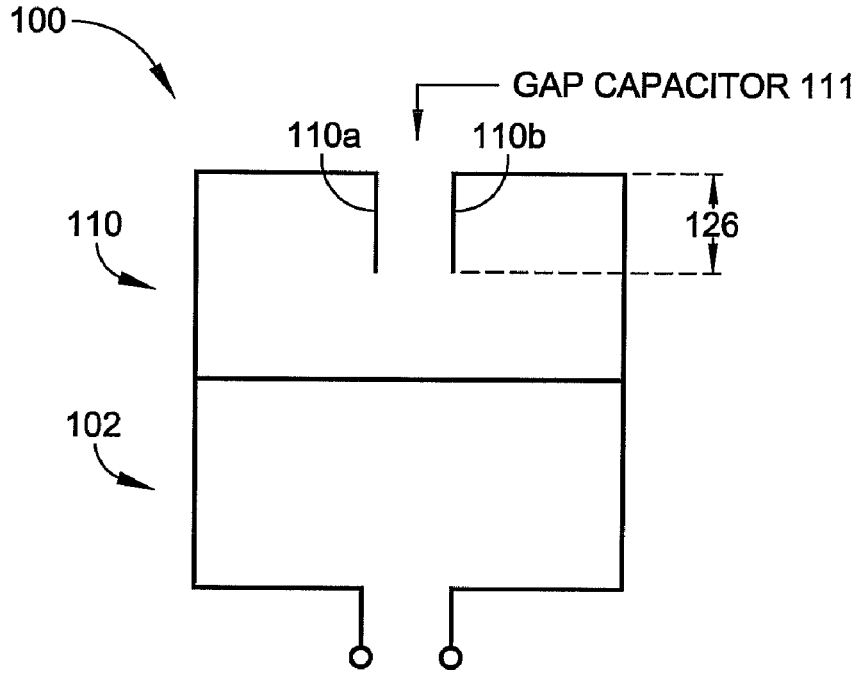
FIG. 11 is a depiction of a seventh variation of the antenna of FIG. 1A.

FIG. 11 is a depiction of a seventh variation of the antenna of FIG. 1A. As shown, the bridge section 111 is a dielectric gap capacitor formed between first and second end sections 110*a*/110*b* that have an overlap 126 that is folded into the center of the quasi loop 110.

Figure 12:
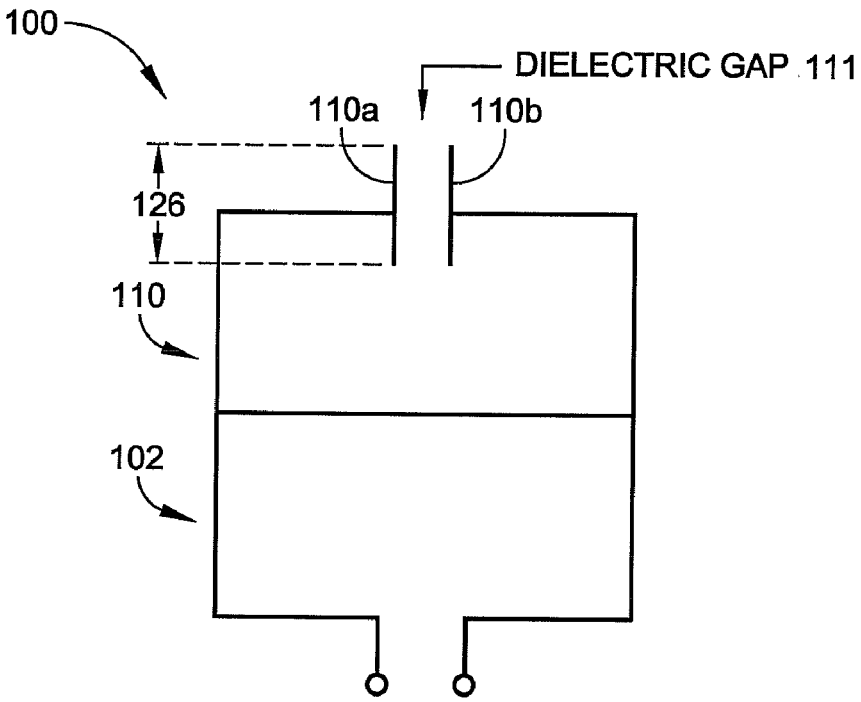
FIG. 12 is a depiction of an eighth variation of the antenna of FIG. 1A.

FIG. 12 is a depiction of an eighth variation of the antenna of FIG. 1A. As shown, the bridge section 111 is a dielectric gap capacitor. The first and second end sections have an overlap 126 that is folded both into the center, and out from the center of the quasi loop 110. Alternately stated, the parallel or overlapping parts of first and second end sections 110*a*/110*b* are perpendicular to the other parts of the first and second end sections that form the quasi loop perimeter.

Figure 13:
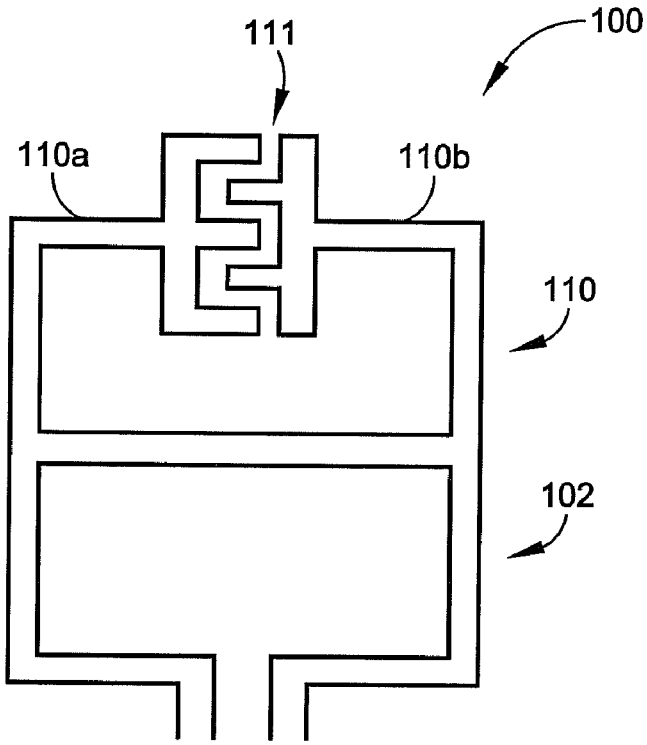
FIG. 13 is a depiction of a ninth variation of the antenna of FIG. 1A.

FIG. 13 is a depiction of a ninth variation of the antenna of FIG. 1A. As shown, the bridge section 111 is an interdigital dielectric gap capacitor. FIGS. 11, 12, and 13 depict just three of the many possible ways in which it is possible to form overlapping or parallel portions of the first and second end sections. The invention is not limited to any particular first and second end section shapes.

Figure 7:
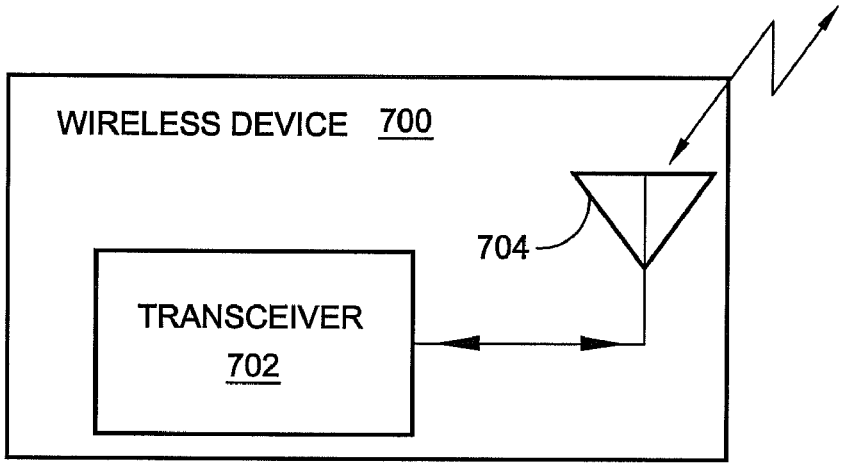
FIG. 7 is a schematic block diagram of the present invention portable wireless telephone communications device capacitively-loaded loop antenna.

FIG. 7 is a schematic block diagram of the present invention portable wireless telephone communications device capacitively-loaded loop antenna. The wireless telephone device 700 comprises a telephone transceiver 702. The invention is not limited to any particular communication format, i.e., the format may be CDMA or GSM. Neither is the device 700 limited to any particular range of frequencies. The wireless device 700 also comprises a balanced feed capacitively-loaded loop antenna 704. Details of the antenna 704 are provided in the explanations of FIGS. 1A through 6 and 10 through 13, above, and will not be repeated in the interests of brevity. The variations of the antenna shown in either FIGS. 5A and 5B, or 6 are examples of specific implementations that can be used in a portable wireless telephone. Note, the invention is also applicable to other portable wireless devices, such as two-way radios and GPS receivers, to name a couple of examples.

Figure 8:
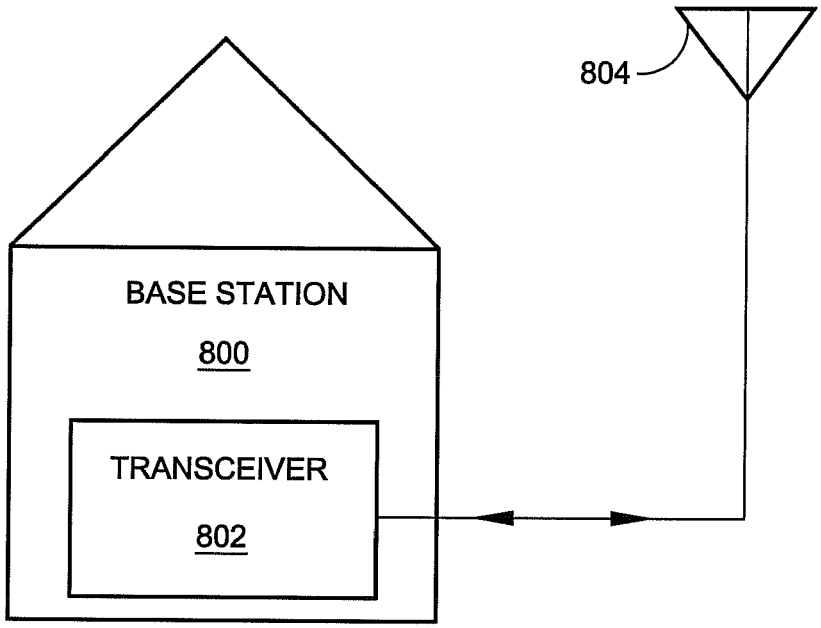
FIG. 8 is a schematic block diagram of the present invention wireless telephone communications base station with a capacitively-loaded loop antenna.

FIG. 8 is a schematic block diagram of the present invention wireless telephone communications base station with a capacitively-loaded loop antenna. The base station 800 comprises a base station transceiver 802. Again, the invention is not limited to any particular communication format or frequency band. The base station 800 also comprises a balanced feed capacitively-loaded loop antenna 804, as described above. The base station may use a plurality of capacitively-loaded loop antennas 804. The present invention antenna advantageously reduces coupling between individual antennas and reduces the overall size of the antenna system.

Functional Description

Figure 9:
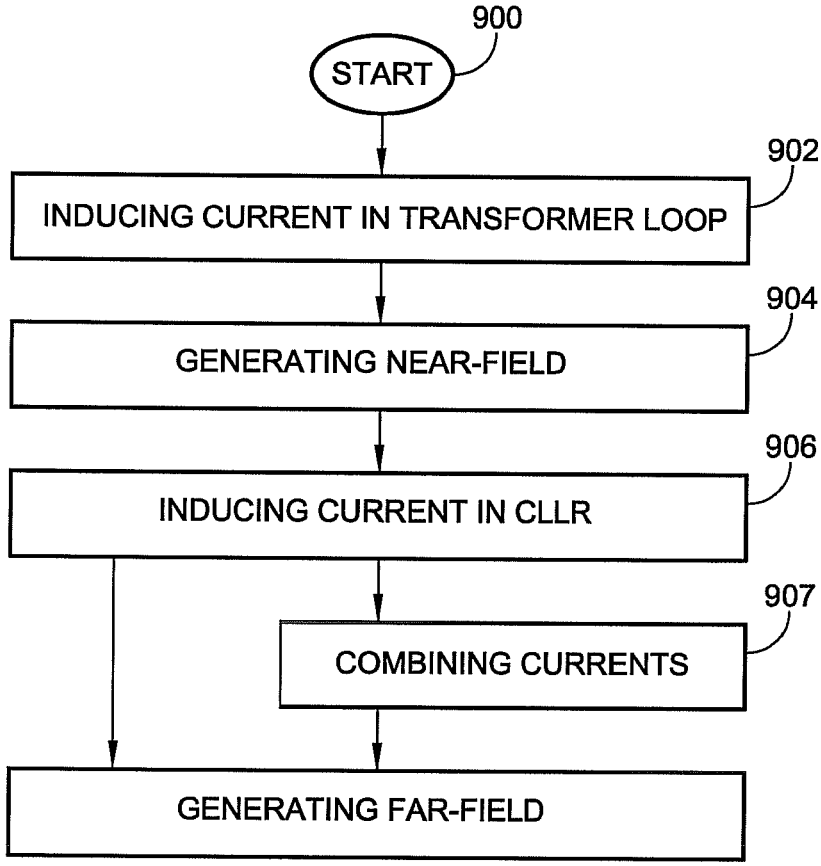
FIG. 9 is a flowchart illustrating the present invention capacitively-loaded loop radiation method.

FIG. 9 is a flowchart illustrating the present invention capacitively-loaded loop radiation method. Although the method is depicted as a sequence of numbered steps for clarity, no order should be inferred from the numbering unless explicitly stated. It should be understood that some of these steps may be skipped, performed in parallel, or performed without the requirement of maintaining a strict order of sequence. The method starts at Step 900.

Step 902 induces a first electrical current flow through a transformer loop from a balanced feed. Step 904, in response to the first current flow thorough the transformer loop, generates a magnetic near-field. Step 906, in response to the magnetic near-field, induces a second electrical current flow through a capacitively-loaded loop radiator (CLLR). Step 908 generates an electro-magnetic far-field in response to the current flow through the capacitively-loaded loop radiator. As described above, the CLLR includes a quasi loop and bridge section. Alternately stated, Step 908 generates an electromagnetic far-field by confining an electric field. Step 908 may generate a balanced electromagnetic far-field. Generally, these steps define a transmission process. However, it should be understood that the same steps, perhaps ordered differently, also describe a radiated signal receiving process.

In some aspects, such as when the loops are physically connected (see FIG. 1B), an additional step, Step 907, generates a third electrical current flow, which is a combination of the first and second current flows through a loop perimeter section shared by both the transformer loop and the capacitively-loaded loop radiator. For example, the first and second currents may tend to cancel, yielding a net (third) current of zero. Typically, a more perfectly balanced radiator results in lower value of third current flow.

In another aspect, generating a magnetic near-field in response to the first current flow thorough the transformer loop in Step 904 includes generating the magnetic near-field orthogonal to a transformer loop area formed in a first plane. Then, inducing a second electrical current flow through a capacitively-loaded loop radiator in response to the magnetic near-field (Step 906) includes accepting the magnetic near-field orthogonal to a capacitively-loaded loop radiator area formed in a second plane.

For example, generating the magnetic near-field orthogonal to a transformer loop area formed in a first plane (Step 904), and accepting the magnetic near-field orthogonal to a capacitively-loaded loop radiator area formed in a second plane (Step 906), may include the first and second planes being coplanar (see FIG. 1A). In another aspect, the first and second planes are non-coplanar (while remaining orthogonal to the near-field), see FIG. 3. In other aspects, the CLLR second plane is not orthogonal to the near-field generated in Step 904 (see FIG. 6).

In another aspect the loops are physically independent, see FIG. 2. Then, inducing a first electrical current flow through a transformer loop (Step 902) includes inducing only the first current flow through all portions of the transformer loop. Inducing a second electrical current flow through a capacitively-loaded loop (Step 906) includes inducing only the second current flow through all portions of the capacitively-loaded loop. Alternately stated, the transformer loop and the CLLR do not share any electrical current flow.

In a different aspect, inducing a first electrical current flow through a transformer loop from a balanced feed (Step 902) includes accepting a first impedance from the balanced feed. Then, inducing a second electrical current flow through a capacitively-loaded loop radiator in response to the magnetic near-field (Step 906) includes transforming the first impedance to a second impedance, different from the first impedance. Alternately stated, the transformer loop provides an impedance transformation function between the balanced feed and the CLLR.

A balanced feed, capacitively-loaded loop antenna and capacitively-loaded loop radiation method have been provided. A confined electric field magnetic dipole has also been presented. Some specific examples of loop shapes, loop orientations, bridge and electric field confining sections, physical implementations, and uses have been given to clarify the invention. However, the invention is not limited to merely these examples. Other variations and embodiments of the invention will occur to those skilled in the art.

What is claimed is:

1. A wireless telephone communications device, the device comprising:
- a telephone transceiver; and
- a balanced feed capacitively-loaded loop antenna connected to the transceiver, wherein the antenna includes:
  - a transformer loop having a balance feed interface, where the transformer loop has a first perimeter, and
  - a capacitively-loaded loop radiator having a second perimeter with at least a portion of the second perimeter in common with the first parameter connecting the capacitively-loaded loop radiator in parallel with the transformer loop.

2. The device of claim 1 wherein the capacitively-loaded loop radiator is a balanced radiator.

3. The device of claim 1 wherein the capacitively-loaded loop radiator includes:
- a quasi loop with a first end section and a second end section; and
- a bridge section interposed between the quasi loop first and second end sections.

4. The device of claim 3 wherein the bridge section is an element selected from the group including a dielectric gap capacitor and a lumped element capacitor.

5. The device of claim 3 wherein the transformer loop has a loop area in a first plane defined by a first perimeter, orthogonal to a first magnetic field; and,
- wherein the quasi loop has a loop area in a second plane, defined by a second perimeter, orthogonal to the first field.

6. The device of claim 1 wherein the transformer loop has a rectangular shape with a first side; and,
- wherein the quasi loop has a rectangular shape with the first side.

7. A wireless telephone communications device, the device comprising:
- a telephone transceiver; and
- a balanced feed capacitively-loaded loop antenna connected to the transceiver, wherein the antenna includes:
  - a transformer loop configured to generate a magnetic near field, where the transformer loop has a first perimeter, and
  - a capacitively-loaded loop radiator having a second perimeter, where the second perimeter is physically independent with the first parameter, wherein the capacitively-loaded loop radiator is coupled to the transformer loop through the magnetic near field.

8. A wireless telephone communications base station with a capacitively-loaded loop antenna, the base station comprising:

a base station transceiver; and, a balanced feed capacitively-loaded loop antenna, wherein the antenna includes:

a transformer loop having a balance feed interface, where the transformer loop has a first perimeter, and a capacitively-loaded loop radiator having a second perimeter with at least a portion of the second perimeter in common with the first parameter connecting the capacitively-loaded loop radiator in parallel with the transformer loop.

9. The base station of claim 8 wherein the capacitively-loaded loop radiator is a balanced radiator.

10. The base station of claim 8 wherein the capacitively-loaded loop radiator includes:

a quasi loop with a first end section and a second end section; and a bridge section interposed between the quasi loop first and second end sections.

11. The base station of claim 10 wherein the bridge section is an element selected from the group including a dielectric gap capacitor and a lumped element capacitor.

* * * * *